United States Patent [19]

Satoh

[11] Patent Number: 4,496,497

[45] Date of Patent: Jan. 29, 1985

[54] CARBURETOR ASSEMBLY

[75] Inventor: Yoichi Satoh, Zama, Japan

[73] Assignee: Nippon Carburetor Co., Ltd., Tokyo, Japan

[21] Appl. No.: 496,183

[22] Filed: May 19, 1983

[30] Foreign Application Priority Data

May 27, 1982 [JP] Japan ..... 57-88903

[51] Int. Cl.[3] ..... F02M 3/08

[52] U.S. Cl. ..... 261/41 D; 261/72 R

[58] Field of Search ..... 261/72 R, 41 D

[56] References Cited

U.S. PATENT DOCUMENTS

| | | | |
|---|---|---|---|
| 1,520,210 | 12/1924 | Riotte | 261/72 R |
| 1,865,488 | 7/1932 | Tice | 261/72 R |
| 1,945,189 | 1/1934 | Goodman | 261/72 R |
| 2,116,608 | 5/1938 | Seignol et al. | 261/72 R |
| 2,544,289 | 3/1951 | Andrews | 261/72 R |
| 2,656,166 | 10/1953 | Foster | 261/72 R |
| 3,093,699 | 6/1963 | Demitz | 261/72 R |
| 3,231,250 | 1/1966 | Kalert, Jr. | 261/72 R |
| 4,003,968 | 1/1977 | Rickert | 261/72 R |

FOREIGN PATENT DOCUMENTS

| | | | |
|---|---|---|---|
| 130976 | 7/1919 | United Kingdom | 261/72 R |
| 308984 | 10/1930 | United Kingdom . | |
| 401742 | 11/1933 | United Kingdom . | |
| 1074828 | 7/1967 | United Kingdom . | |

*Primary Examiner*—Tim Miles

*Attorney, Agent, or Firm*—Brumbaugh, Graves, Donohue & Raymond

[57] ABSTRACT

A carburetor assembly comprising an air intake tube having a venturi section therein, a hollow cylindrical body in which the air intake tube is inserted, a float chamber, a cover for the float chamber and a clamping device. These members are individually formed and assembled with each other. The assembled members are secured by means of the clamping device.

3 Claims, 9 Drawing Figures

CARBURETOR ASSEMBLY

BACKGROUND OF THE INVENTION

This invention relates to a carburetor, and more particularly to an improved carburetor assembly in which main elements are separately constructed for assembly.

A carburetor ordinarily consists of an air intake or induction pipe including a narrowed venturi section, a float chamber, an air valve or choke valve, a throttle valve and the like. In general, a main carburetor is formed or molded from zinc alloy and other light metal alloys in a body.

A molded carburetor of this type has to be machined using a drilling machine or the like to bore a number of passages in the carburetor body. This procedure has the disadvantage that it is difficult to make many complicated passages in the carburetor body, in that metal chips remain in the bores, and that it requires skill and avoidable expense in working.

In view of the above, it is a principal object of the present invention to provide a carburetor assembly which is mechanically simple, and inexpensive to manufacture.

It is another object of the present invention to provide a carburetor assembly which can be made without drilling a number of holes or passages such as fuel or air bleed passages in the carburetor body.

It is still another object of the present invention to provide a carburetor assembly in which an air intake passage is formed from a hollow cylindrical body and a member for forming a venturi section therein, portions of passage being formed in the outer wall of the cylindrical body.

It is a further object of the present invention to provide a carburetor assembly in which the passages can readily be changed in accordance with the fuel system for the engine.

It is an object of the present invention to provide a carburetor assembly in which main parts can be secured to each other.

BRIEF DESCRIPTION OF DRAWINGS

These and other objects and many of the attendant advantages of the present invention will be readily appreciated as the same becomes better understood by reference to the following detailed description when considered in connection with the accompanying drawings in which.

BEST MODE OF CARRYING OUT THE INVENTION

Figure 1:
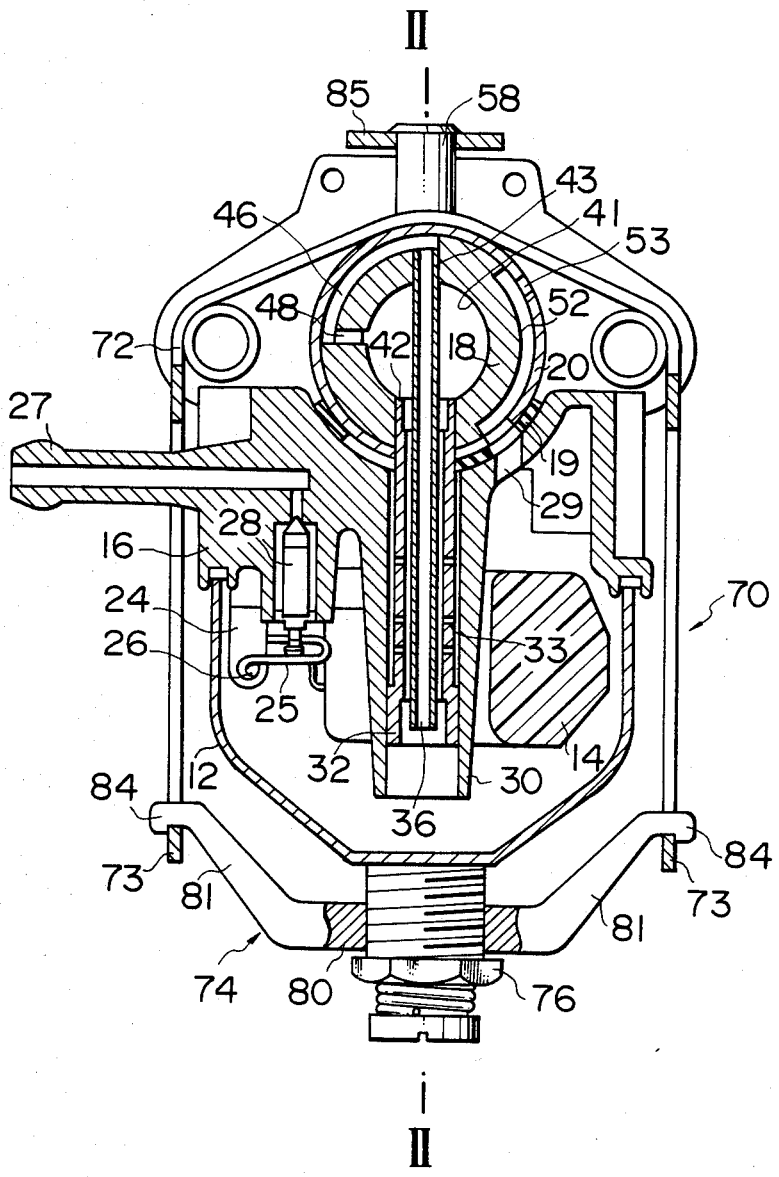
FIG. 1 is a vertical cross section illustrating an embodiment of a carburetor assembly in accordance with the invention.
Figure 2:
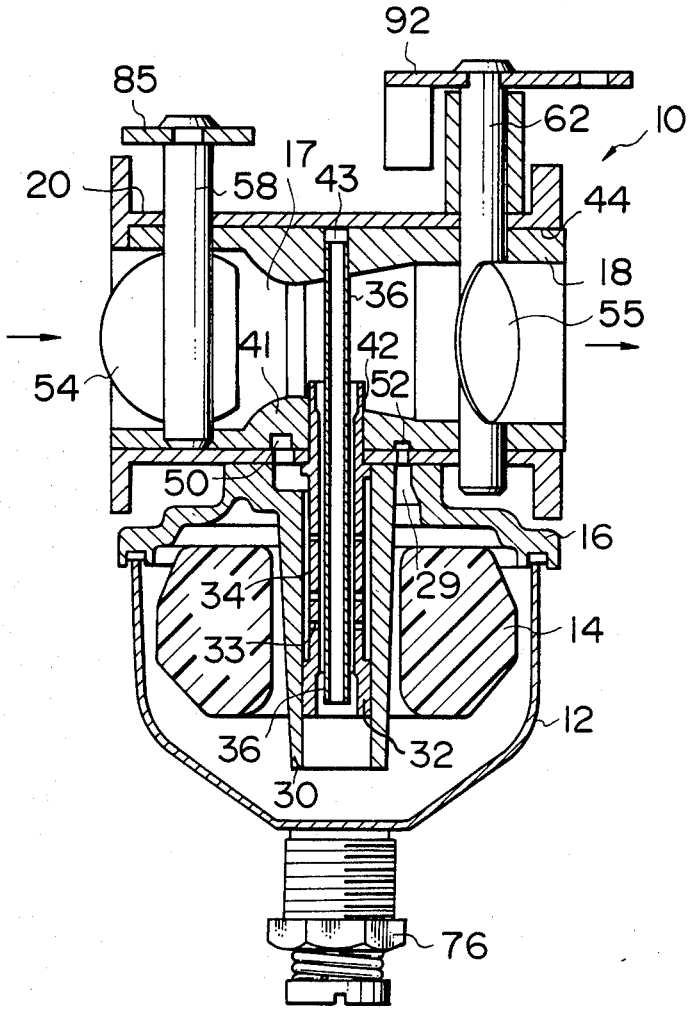
FIG. 2 is a cross section taken substantially on line II—II of FIG. 1.

Referring to FIGS. 1 and 2, there is shown a preferred embodiment of a carburetor assembly 10 of the present invention. This assembly comprises a float chamber 12, a float 14 provided within the float chamber 12, a cover 16 for the float chamber, an air intake pipe 18 having a venturi section 17 therein, a hollow cylindrical body 20 for supporting the air intake pipe 18 on the cover 16 through gaskets 19 if desired, and fuel passages for supplying the fuel from the float chamber 12 to desired portions of the air intake pipe 18.

The float chamber 12 may be made from a sheet metal such as an iron plate, aluminium plate or the like and may be in the form of a cup. The float chamber 12 is closed by the cover 16 which may have a support 24 protruding from the under surface of the cover for mounting the float 14 by means of a pin 26. The cover 16 has a fuel supply passage 27 for supplying the fuel to the float chamber 12 from a fuel pump (not shown) and in order to maintain the fuel in the chamber 12 at a constant level, a needle valve 28 movable with the float 14 is arranged at an outlet of the fuel supply passage 27.

The cover 16 has an air vent port 29 adjacent the center thereof and is provided with a pipe 30 so as to extend downwardly from the center of the cover 16. A main nozzle 32 may be inserted coaxially into the pipe 30. In assembling, the upper end 42 of the main nozzle 32 is terminated at a throat 41 of the venturi section 17. A plurality of small holes 33 are formed in the wall of the main nozzle 32. Air is introduced into the space 34 between the pipe 30 and the main nozzle 32 and is mixed with the fuel passing through the space 34.

A slow fuel supply tube 36 may be inserted coaxially into the main tube 32 and the upper end of the slow fuel supply tube 36 is extended upwardly beyond the upper end 42 of the main nozzle 32 so as to terminate at the outer wall surface of the intake pipe 18 at a diametrically opposite side to the open end of the main nozzle 32.

Figure 3:
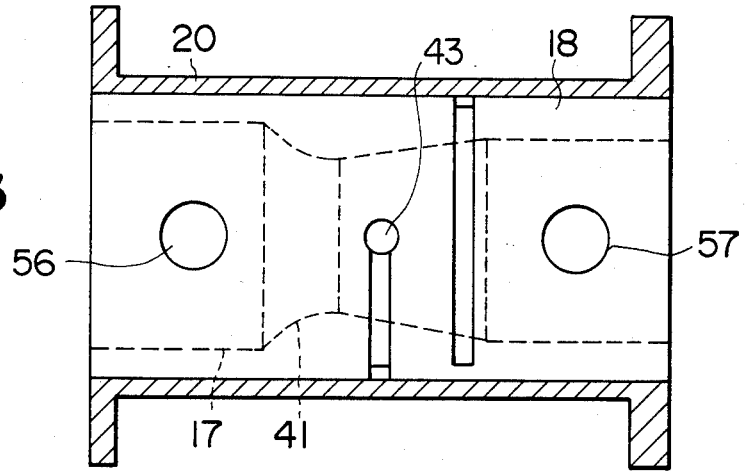
FIG. 3 is a plan view of an air intake pipe inserted into a hollow cylindrical body which is shown in cross section.
Figure 4:
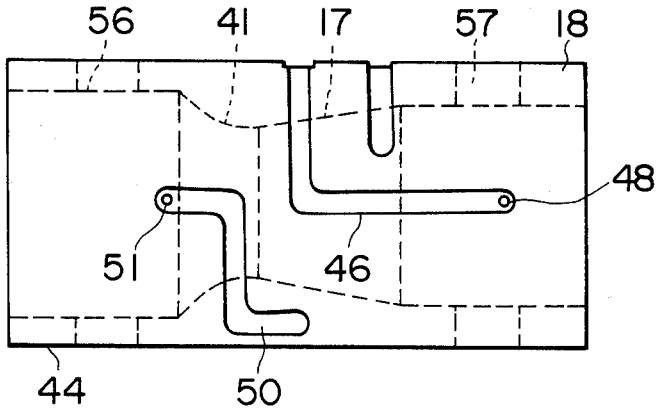
FIG. 4 is a front elevation of the intake passage.
Figure 5:
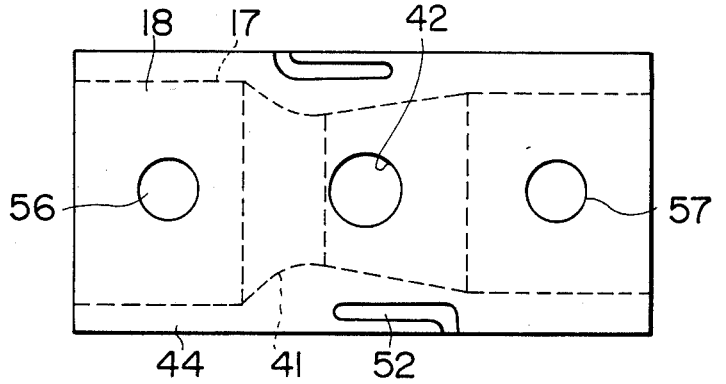
FIG. 5 is a bottom view of the intake passage.
Figure 6:
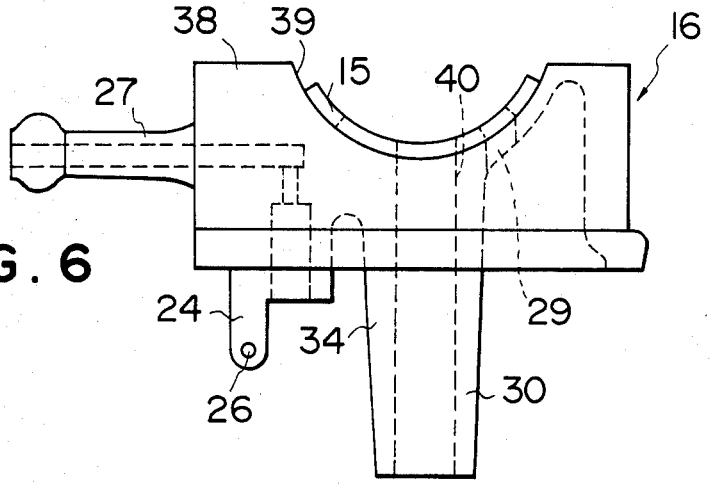
FIG. 6 is a side elevation of a cover of a float chamber.

The air intake pipe 18 may be formed by a hollow cylindrical body having a thick wall, which is narrowed to reduced diameter to form a throat 41 of the venturi, as shown in FIGS. 3 to 5. An opening 42 is formed in the throat 41 to receive the upper end of the main nozzle 32 and an opening 43 for the slow fuel supply tube 36 is formed in the side wall of the air intake pipe 18 opposite to the opening 42. A groove 46 is formed in the outer surface 44 of the air intake pipe 18 and the groove 46 may be connected with the opening 43 of the slow fuel supply tube 36. The groove 46 may be extended to the downstream side of the air intake pipe 18 and has an opening 48 for injecting the fuel downstream of a throttle valve 55. The air intake pipe 18 and the outer cylindrical body 20 are respectively provided with openings 56 and 57 for mounting a shaft 58 of the choke valve 54 and a shaft 62 of the throttle valve 55.

The outer surface of the air intake pipe 18 also has a narrow groove 50 which communicates with the space 34 formed between the pipe 30 and the main nozzle 32, the groove 50 being extended to the upstream side of the air intake pipe 18. A narrow groove 52 may be formed on the outer wall 44 of the air intake pipe 18 for communicating with the air vent port 29 in the float cover 16. The hollow cylindrical body 20 may be provided with flanges integral with the body or separately.

When the air intake pipe 18 is inserted into the hollow cylindrical body 20, the groove 46 on the outer wall of the air intake pipe 18 is adapted to be used for passing the fuel and the groove 52 serves as an air passage.

A plurality of grooves may be formed on the outer surface of the air intake passage member 18 if necessary. The cylindrical body 20 is provided with an opening 53 to connect with the end of the groove 52 so as to communicate with the air vent opening 29.

According to the carburetor assembly 10 of the invention, after the float chamber 12, the cover 16 and the outer cylindrical body 20 supporting the air intake pipe 18 have been assembled, these members may be secured together by means of a clamping device 70.

Figure 7:
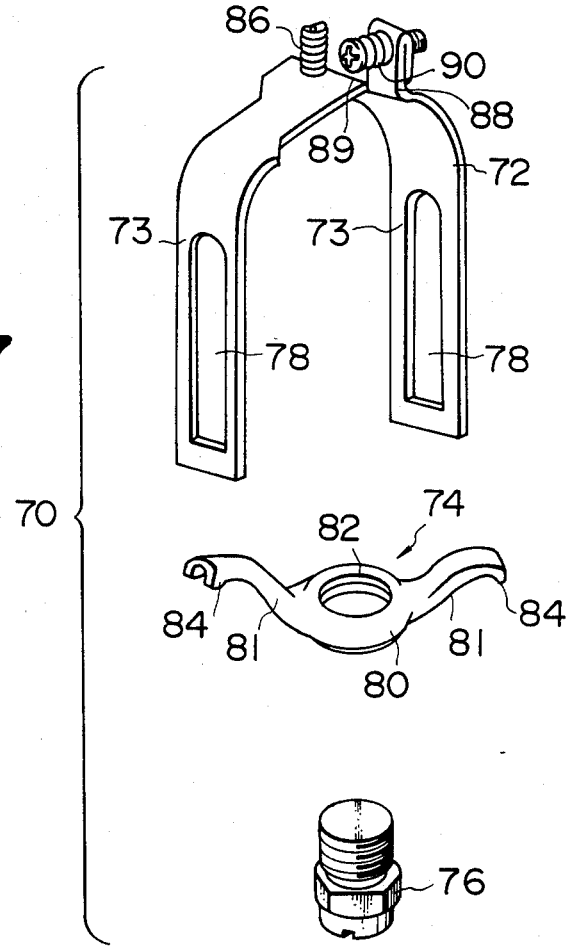
FIG. 7 is an exploded perspective view of a clamping device according to the present invention.
Figure 8:
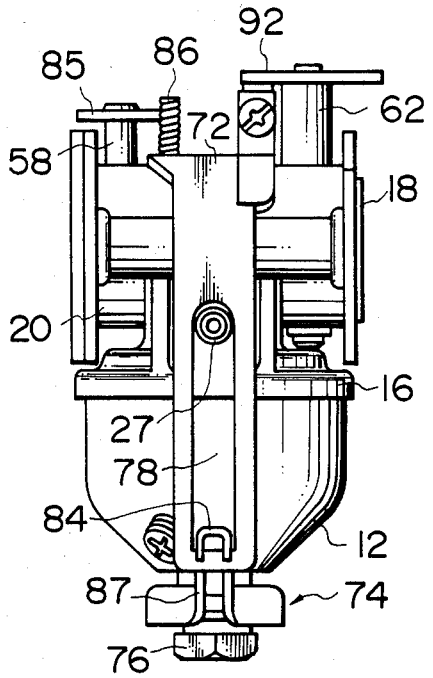
FIG. 8 is a side elevation illustrating an embodiment of a carburetor assembly according to the present invention.
Figure 9:
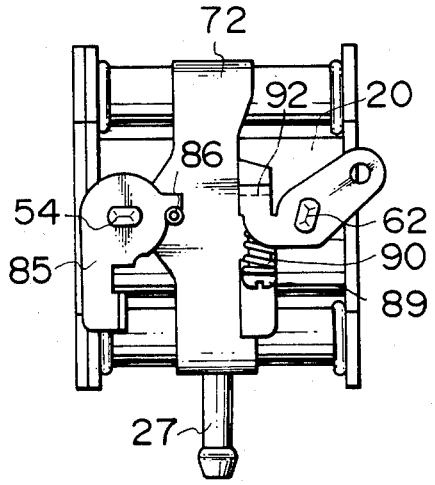
FIG. 9 is a top view of the carburetor assembly of FIG. 8.

As shown in FIG. 7, the clamping device 70 consists of a band 72, a socket 74 and a screw member 76. Preferably the band 72 may be formed to a reversed U-like shape having side plates 73 which extend downwardly to the adjacent portion of the bottom of the float chamber 12 when the band 72 is mounted on the outer cylindrical body 20. Each of the side plates 73 is provided with an elongated opening 78 therein and the fuel supply pipe 27 may be protruded through the opening 78. As shown in FIGS. 1 and 7, the socket 74 has a pair of arms 81 extending from a flat portion 80 having a screw threaded opening 82 therein. The end of each of the arms 81 is formed to a hand 84 for engaging with the lower edge of the elongated opening 78 in the band 72.

The screw member 76 may be screwed into the opening 82 in the socket 74. When the band 70 is mounted on the cylindrical body 20 of the carburetor, each of the hands 84 is engaged with the lower edge of each of the openings 78 in the band 70, and then the screw member 76 is screwed into the screw threaded opening 82 in the flat portion 80 of the socket 74 until the top end of the screw member 76 bears against the bottom of the float chamber 12, so that the float chamber 12, the cover 16 and the cylindrical body 20 mounting the air intake pipe 18 are secured to each other.

According to the carburetor assembly 10 of the present invention, a choke control spring member 86 may be arranged on the band 72 so as to cooperate with a cam plate 85 mounted on the shaft 58 of the choke valve 54 to set the position of the choke valve. A portion of the choke control spring member 86 may be protruded through the band 72 to engage a corresponding depression formed on the outer wall of the cylindrical body 20 so as to align the body to the band member 72.

A portion of the band member 72 may be bent upwardly to form a post 88 for mounting a screw member 89 and a coil spring 90 for contacting a lever 92 mounted on the shaft 62 of the throttle valve 55 with the screw member 89.

Although the invention has been described in its preferred form with a certain degree of particularity, it is understood that the present disclosure of the preferred form may be changed in the details of construction and the combination and arrangement of parts may be altered without departing from the spirit and the scope of the invention as hereinafter claimed.

What is claimed is:

1. A carburetor assembly comprising an air intake pipe having a venturi section therein, an outer cylindrical body in which said air intake pipe is inserted, a float chamber, a cover for said float chamber, the outer wall of said air intake pipe having a plurality of grooves therein forming fuel and air passages, a main nozzle member for communicating said venturi section with said float chamber, a fuel pipe inserted into said main nozzle member, and a clamping means for securing said outer cylindrical body, said cover for the float chamber and said float chamber in assembled relation.

2. A carburetor assembly as claimed in claim 1 in which said cover is provided with a pipe into which said main nozzle is inserted.

3. A carburetor assembly as claimed in claim 1 in which said clamping means consists of a band member, a socket member and a screw member.

* * * * *